US008267098B2

(12) United States Patent
Glucksman

(10) Patent No.: US 8,267,098 B2
(45) Date of Patent: Sep. 18, 2012

(54) HAIR STRAIGHTENER

(75) Inventor: Dov Glucksman, Wenham, MA (US)

(73) Assignee: WIK Far East Ltd., North Point (HK)

( * ) Notice: Subject to any disclaimer, the term of this patent is extended or adjusted under 35 U.S.C. 154(b) by 63 days.

(21) Appl. No.: 12/896,772

(22) Filed: Oct. 1, 2010

(65) Prior Publication Data

US 2012/0080047 A1 Apr. 5, 2012

(30) Foreign Application Priority Data

Oct. 1, 2010 (DE) ..... 20 2009 011 098 U

(51) Int. Cl.
*A45D 24/04* (2006.01)

(52) U.S. Cl. ..... 132/136; 132/137; 132/138

(58) Field of Classification Search ..... 132/136, 132/212, 137–142, 223, 224, 229, 230–232, 132/234, 235, 269, 270, 268, 271, 108, 111, 132/118, 126, 127, 135, 148, 218, 151, 152, 132/161, 901, 333; 34/96, 283; 219/222, 219/225, 227; 119/611, 612, 613, 614, 616, 119/617, 618, 625, 627, 631, 632
See application file for complete search history.

(56) References Cited

U.S. PATENT DOCUMENTS 466,496 A * 1/1892 Heysinger ..... 132/137
844,007 A * 2/1907 Ehrlich ..... 132/138
1,002,942 A * 9/1911 Taylor ..... 132/117
1,197,264 A * 9/1916 Cobb ..... 132/136
1,349,425 A * 8/1920 Howard et al. ..... 132/118
1,523,461 A * 1/1925 Swan ..... 132/118
1,614,631 A * 1/1927 Sendlbeck ..... 132/136
2,176,460 A * 10/1939 Kruger et al. ..... 132/135
2,255,618 A * 9/1941 Huppert ..... 132/157
2,562,465 A * 7/1951 Kassel ..... 132/119
2,685,292 A * 8/1954 Staiano ..... 132/120
3,088,471 A * 5/1963 Fiore ..... 132/136

(Continued)

FOREIGN PATENT DOCUMENTS

DE 7925952 1/1980

(Continued)

OTHER PUBLICATIONS

European Search Report for related European patent application EP 10176179.9 mailed on Dec. 1, 2010 (4 pages).

*Primary Examiner* — Vanitha Elgart
(74) *Attorney, Agent, or Firm* — Margaret Polson; Oppedahl Patent Law Firm LLC

(57) ABSTRACT

A hair straightener device encompasses a straightening tool that is comb-like. The straightening tool has a row of tines that are spaced apart respectively to each other by one hair receptacle. Each tine is associated with at least one first molded part 7 that is movably mounted. It is movably supported relative to the additional tine that surrounds the hair receptacle. The straightening tool furthermore surrounds a second molded part which is associated with the additional tine that surrounds this hair receptacle. This serves the implementation of a hair shaping gap between the molded parts of a hair receptacle. The hair shaping gaps that are located between the molded parts are undercut at least in the hair shaping position of the molded parts toward one another in the direction toward the border, of the hair receptacle, that connects the tines.

11 Claims, 5 Drawing Sheets

U.S. PATENT DOCUMENTS

| | | | | | |
|---|---|---|---|---|---|
| 3,850,180 | A | * | 11/1974 | Ryckman et al. | 132/112 |
| 3,927,684 | A | * | 12/1975 | Lam | 132/119.1 |
| 4,126,143 | A | * | 11/1978 | Schroeder | 132/118 |
| 4,702,265 | A | * | 10/1987 | Weddington | 132/118 |
| 5,449,007 | A | * | 9/1995 | Arnhols | 132/136 |
| 5,771,904 | A | * | 6/1998 | Lange et al. | 132/159 |
| 6,278,086 | B1 | | 8/2001 | Janouch et al. | |
| 6,895,975 | B2 | | 5/2005 | Hafemann | |
| 7,490,615 | B2 | * | 2/2009 | Rizzuto | 132/129 |
| D609,857 | S | | 2/2010 | Schmitz | |
| 2009/0199864 | A1 | | 8/2009 | Smal | |
| 2009/0266378 | A1 | | 10/2009 | Nunomura | |

FOREIGN PATENT DOCUMENTS

| | | |
|---|---|---|
| DE | 19750119 | 5/1999 |
| EP | 1721539 | 11/2006 |
| WO | 2004066779 | 8/2004 |
| WO | 2009007521 | 1/2009 |

* cited by examiner

HAIR STRAIGHTENER

CROSS REFERENCE APPLICATIONS

This application claims the benefit of German Application No. 20 2009 011 098.2, filed Oct. 1, 2009, which is incorporated herein by reference for all purposes.

BACKGROUND

Hair straightener devices, so-called straighteners, can be equipped with a smoothing tool that is comb-like. The straightening tool of such devices encompasses one comb sequence that is formed by tines that are spaced apart, wherein respectively two neighboring tines that are disposed at a distance to one another surround one hair receptacle. During the hair straightening process each hair receptacle, or at least one of the two tines that surround each hair receptacle, have access to a first molded part. This one is supported in a movable manner relative to the additional tine that surrounds the hair receptacle. Associated with the first molded part of each hair receptacle is a second molded part. Between the two molded parts, which for the process of the shaping of the hair act against one another subject to pre-load, is located a hair shaping gap into which a hair strand is placed for the purpose of straightening. The straightening is accomplished by positioning the hair straightener device at the hair root section of the hair section to be straightened, inserting of the hair strands into the hair receptacles of the straightening tool and the pulling of the hair strands gathered by the hair receptacles through the straightening tool. This takes place typically during a corresponding movement of the hair straightener device relative to the head of the person whose hair is to be straightened.

In a prior art hair straightener the first movably supported molded parts are individually spring supported at each tine. In such a hair straightener the insertion of a hair strand into a hair shaping gap takes place against the force of the spring element acting on the first molded parts. The straightening movement is executed when the hair is located in the several hair shaping gaps. In the process the spring force that is acting on the individual first molded parts determines that force that acts on the hair for the process of the straightening. The second molded part then represents the abutment. This prior art hair straightener has a hot air blower whose heated air stream is guided into the straightening tool for providing the required heat for the hair straightening process. The straightening tool itself has air exhaust openings in the area of the root areas of the rigid tines in order for the heated air stream to reach the hair to be shaped.

An additional hair straightener device of the type is disclosed in EP 1 721 539 A1. This hair straightener device differs from the previously described one in that the first molded parts are connected to one another by a bar and that these molded parts can be moved as a whole molded part unit relative to the rigid tines against the force of a reset spring. The molded part unit can be brought into the position that opens the hair shaping gap by an actuator. This has the advantage that the insertion of the hair strands into the respective hair shaping gaps is simplified. Furthermore it is possible in the case of this embodiment to adjust the reset force and thereby the force that is acting on the hairs for the process of the hair straightening. This previously known hair straightener also has a hot air blower to the supply the heat required for the hair shaping.

In the case of the above prior art comb-like hair straighteners devices, it has been shown that during the process of the hair shaping, some or all of hair strands emerge from the hair shaping gap in sufficiently straightened. Therefore, in order for all the desired hairs to be straightened, the straightening process has to be repeated several times.

If heat is supplied to the hair to be shaped by an air stream, in addition to heat the hair, the heated air stream also dries the hair. However, sometimes a quick drying of the hair to be shaped is undesirable.

In addition to the prior art comb hair straightener devices, there are those also hair straighteners that consist of two tong-like arms next to each other, wherein each arm encompasses a molded part pointing to the other arm. These molded parts are implemented in a plate-like manner with a level surface. The force acting on the hair to be straightened is brought to bear on the arms manually by the user by a closing movement, and therefore because of the exerted closing force. Due to the relatively large hair shaping surface there is no danger in these hair straighteners that individual hair strands escape from the hair shaping gap during the execution of the typical straightening movement. However, with these hair straightener devices care has to be taken that too large an amount of hair is not place in the hair shaping gap. This in turn can generally not occur in the previously described hair comb-like straightening tools with a straightening tools as a result of the hair strand separation that is thereby carried out.

The foregoing example of the related art and limitations related therewith are intended to be illustrative and not exclusive. Other limitations of the related art will become apparent to those of skill in the art upon a reading of the specification and a study of the drawings.

SUMMARY

The disclosure concerns a comb-like hair straightener tool that has tines spaced apart respectively to each other and disposed in a row, with at least one molded part that is associated with each tine and disposed in a movable manner relative to an additional tine that surrounds this hair receptacle and with a second molded part that is associated with one of the additional tines surrounding this hair receptacle for the purpose of implementing a hair shaping gap between the two molded parts of a hair receptacle.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

An aspect of the invention with the comb type of hair straightener device were the hair shaping gaps that are located between the molded parts, at least in the hair shaping position of the molded parts, are undercut to one another in the direction of the border of the hair receptacles that connects the tines.

In this hair straightener the hair shaping gaps that are respectively surrounded by the two molded parts are implemented in an undercut manner. The undercut extends in the direction to the border of the hair receptacles that extends between the tines. Consequently the hair shaping gap expands after a constriction in the direction of the hairs to be inserted into a hair shaping gap. The hair strands to be shaped during the straightening process are therefore located in a hair shaping gap that tapers toward the tip of the tine. As a result the hair shaping gap located between the two molded parts is fundamentally closed during the process of hair straightening by the partial abutment of the two molded parts next to each other, in contrast to the previously mentioned hair straighteners.

If the hair shaping gap is not completely closed after the insertion of the hair strand because too large hair strand was placed the hair shaping gap, then the excess hair that prevented a closure of the hair shaping gap will emerge from the hair shaping gap during the course of the hair shaping process as the straightening device is pulled through the hair. Consequently, after a sufficient amount of hair has come out of the shaping gap, the shaping gap is closed by the abutment of the two molded parts in the area of the constriction that forms the undercut. Since the process of the adaptation of too large a strand within the hair shaping gap to the prescribed maximal size typically occurs during the beginning of a hair straightening movement, the shaping process of the additional hairs that remain in the hair shaping gap is not affected. Consequently, with this hair straightener device it is simultaneously assured that the hair shaping process is always the same, or at least approximately the same, for the respectively shaped hairs or hair strands. By these means the result of the straightening is improved. A frequent repetition of the straightening process is typically not required.

This type of hair shaping gap or the molded parts that surround a hair shaping gap is suitable for both hair straighteners where the movable molded parts are supported independently for each tine as well as for hair straighteners where the movable hair shaping parts are combined to one molded part unit.

The opening of the hair shaping gap and therefore the constriction for the implementation of the undercut is typically located in the area of the cover of the molded part on the tine's upper side to be able to utilize the first movably supported molded parts for the process of the hair shaping in the most extensive manner. One will however equip the movable molded parts with a slant that slopes toward the constriction for the purpose of the easier insertion of a hair strand into a hair shaping gap.

In one example the movable molded parts are connected with one another by at least one bar and form a rigid molded part unit. Said unit is movably supported relative to the rigid tines. It is of a particular advantage if such a molded form unit is manufactured from a material that conducts heat well, for example an aluminum alloy. The part can be formed by way of pressure die casting or other known means. An electric heating installation can be provided for the heating up of the molded parts as a part of the molded part unit. In such an embodiment the provision of a heated air stream to supply the heat required for the hair shaping process to the hair to be shaped is not required. Rather the hair strands that are inserted in the hair shaping gap are heated immediately by the heated first molded parts. This has the advantage that the hair straightener can be relatively small. A PRC heating element can be suitable as an electric heating installation on the at least one bar that connects the molded parts with one another. The characteristics that conduct heat well permit a quick and even heating up of the molded part unit and therefore of the molded parts that belong to this unit. It is also possible to provide another electric resistance heater at a corresponding position. Furthermore, if the molded part unit is manufactured by die casting it is possible to integrate an electric resistance heater into the molded parts. The heating element is then surrounded by the molded part unit. This embodiment permits the quick heating of the individual molded parts. In an alternative embodiment an electrical heating element integrated into the molded parts unit is located within the one or the many bars that connect the individual molded parts and is typically molded in.

As second molded parts that act together with the first molded parts the tines, which are positioned facing the first molded parts relative to the respective hair receptacle, can serve or at least partially serve. According to an additional embodiment it is provided that the first molded parts are elements that are incorporated into the tines that face the first molded parts. Here too the case may one of a molded parts unit that is formed by means of one or several bars. In such an embodiment it is also useful to manufacture this second molded parts unit from a material that conducts heat well, for example an aluminum alloy. A die casting process can again be used. In this embodiment, the second molded parts can also be equipped with a heater designed as the previously described first molded parts unit. In this embodiment the two molded parts interacting together for the implementation of a hair shaping gap are heated. However, it is viewed as sufficient if only one of the two molded parts is heated. In such a case the other, not heated molded part, is heated by the other molded parts which, during non-use, abut against it due to spring pretension so that for the hair shaping process the two molded parts that implement a hair shaping gap are heated.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
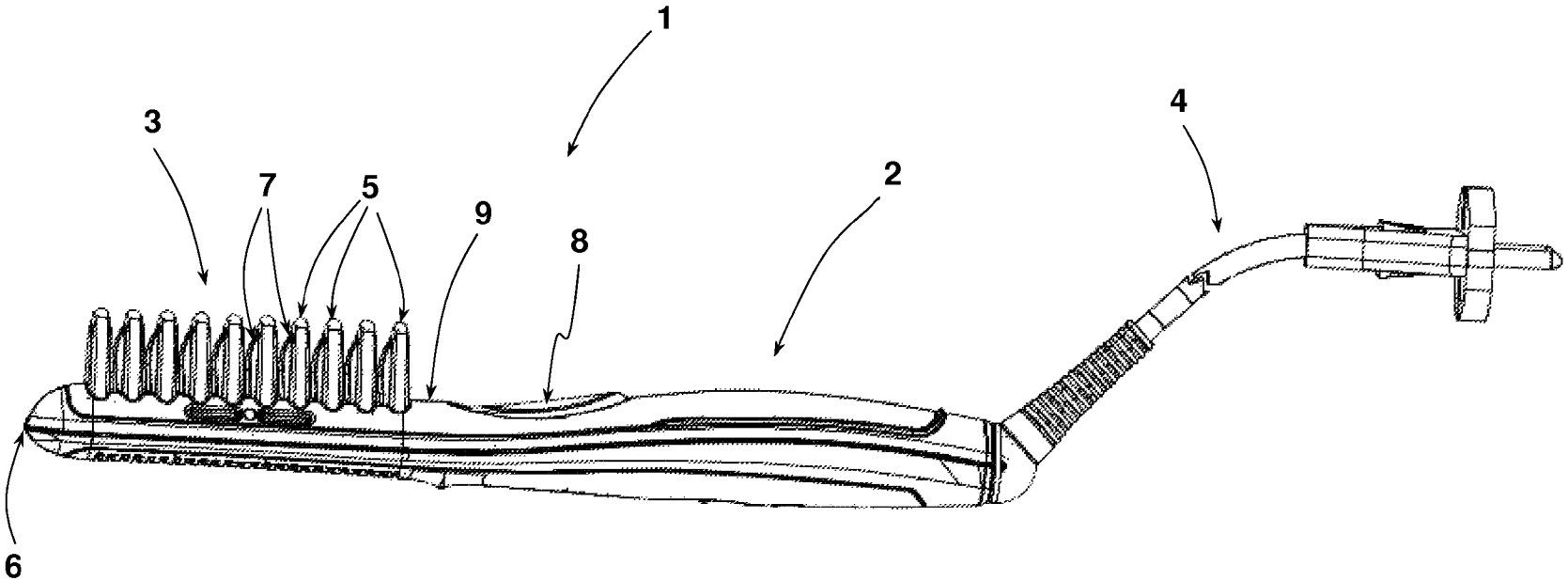
FIG. 1 is a side view of a hair straightener device with straightening tool that is implemented comb-like according to the first embodiment.

Referring first to FIG. 1, a hair straightener 1 has a straightening tool 3 that is connected by means hand grip 2. The straightening tool 3 is electrically heated in the depicted embodiment. The hair straightener 1 has an electrical connection cable 4 for electric current supply. The straightening tool 3 is designed in a comb-like manner and features a row of rigid tines 5 that are spaced apart from one another. With the exception of the outermost tine that is disposed near the tip 6 of the straightening tool 3, each tine 5 of the row of tines is associated a movable first molded part 7. The molded parts 7 are combined to one molded part unit as is described below. The molded parts unit is movable in the direction of the longitudinal extension of the row of tines and can be adjusted from its position shown in FIG. 1 in a translational manner in the direction toward the hand grip 2 by an actuator element that is designed as a button 8 in the depicted embodiment. The tines are implemented together with a cover shell 9 that forms part of the housing of the straightening tool 3 as a plastic injection molded piece.

Figure 2:
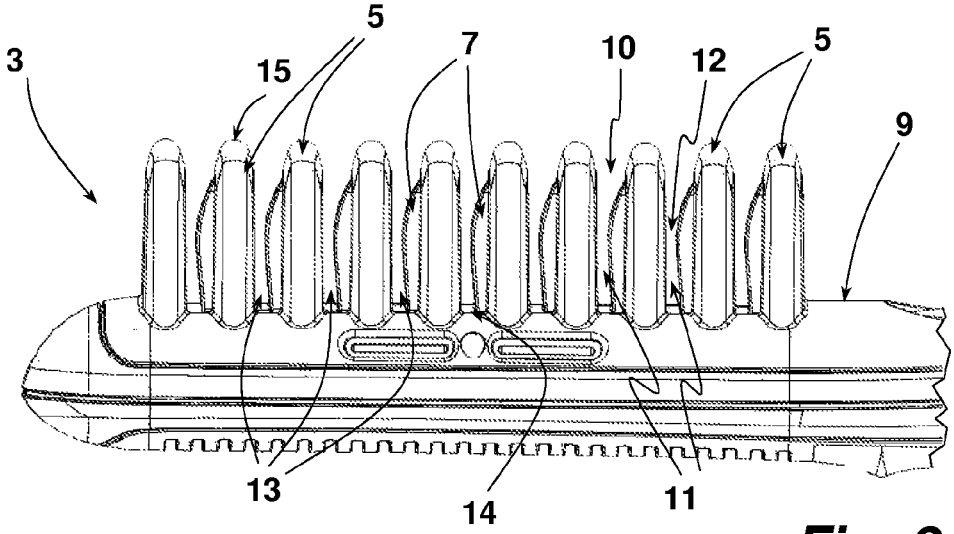
FIG. 2 is an enlarged representation of the straightening tool of the straightening device of FIG. 1 in a lateral view.

The tines 5 are designed in an arch-shaped manner and surround the first molded parts 7, as seen FIG. 2. Two neighboring tines 5 that are disposed toward one another enclose one hair receptacle 10. Part of the hair receptacle 10 is a hair shaping gap 11, shown open in FIG. 2, which extends between each first molded part 7 and the side of the neighboring tine 5 that points to this molded part 7. The first molded parts 7 are moved as a molded part unit by the corresponding actuation of the button 8 against the force of a reset spring relative to the tine 5 that is stationary.

Figure 7:
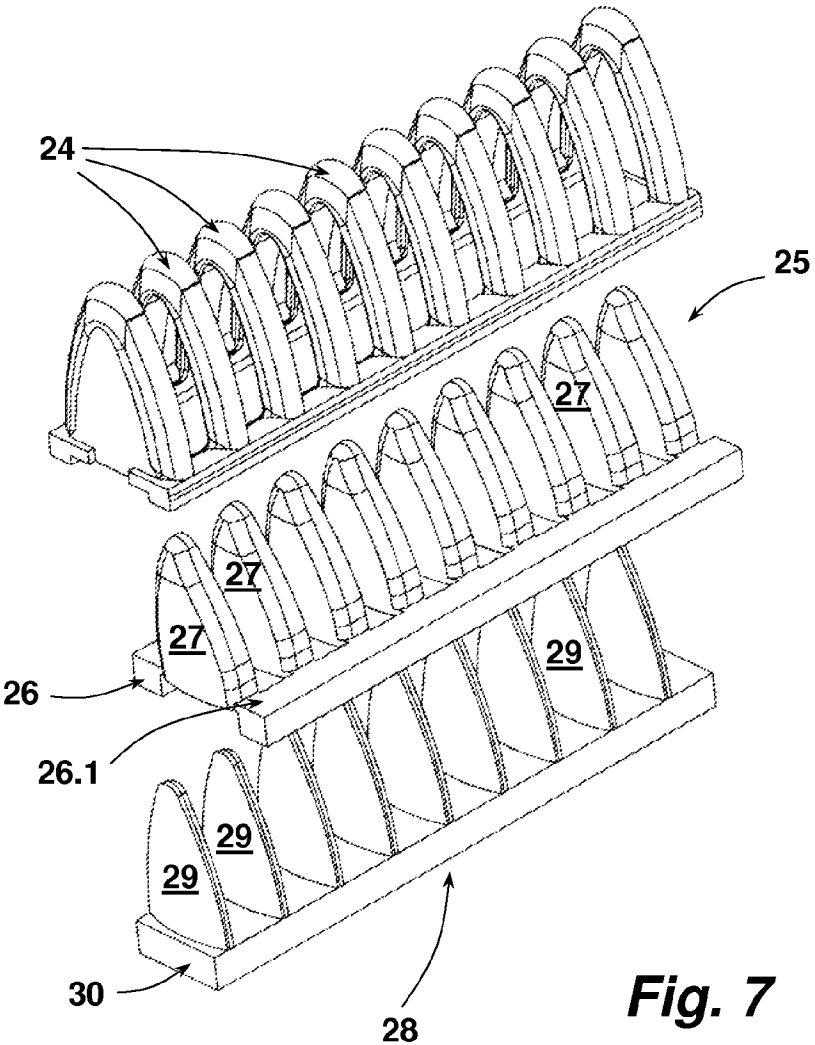
FIG. 7 is an exploded view of the components associated with the construction of the straightening tool of FIG. 6.

As seen FIG. 2, the part surface of the first molded parts 7 that faces the neighboring tines 5 is arched from the tips of the tines 5 to the lower border of the hair shaping gaps 11 to form an undercut 13 that follows a constriction 12. The hair receptacle 10 and the undercut 13 are delimited by a border 14 that extends between neighboring tines 5 and that is formed by sections of the cover shell 9. The section of the molded parts 7 located in the border 14, in reference to the upper end 15, is curved in the direction of the tines 5 that encompass the molded parts 7, in the depicted embodiment, insofar as the curvature extends into the arch that is formed by the tines 5 when the molded parts 7 are in the position that opens the hair shaping gaps, as shown in FIG. 7. By these means an insertion of a hair strand into a hair receptacle or a hair shaping gap 11 is facilitated.

Figure 3:
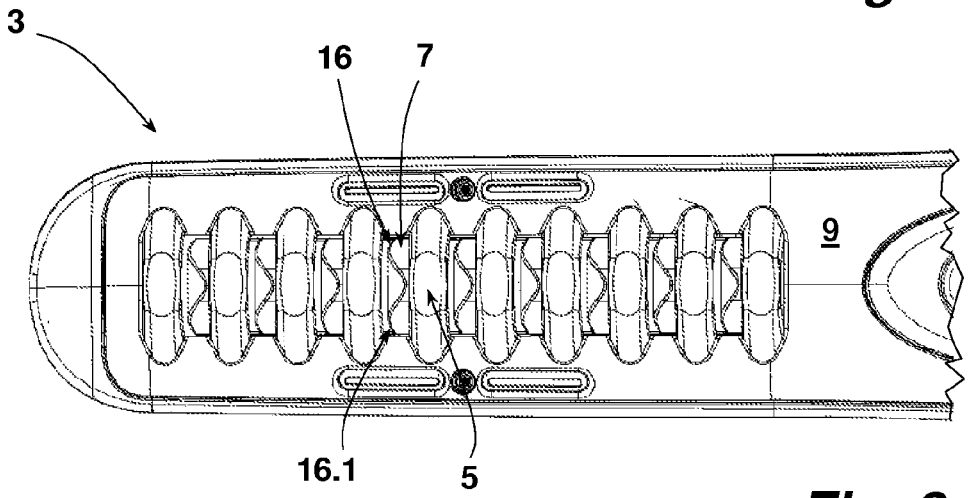
FIG. 3 is an enlarged representation of the straightening tool of the straightening device of FIG. 1 in a plan view.

As seen plan view of FIG. 3, the first molded parts 7 are corrugated in the lateral extension. The corrugation forms two shaping flanks 16, 16.1 in each molded part 7.

Figure 4:
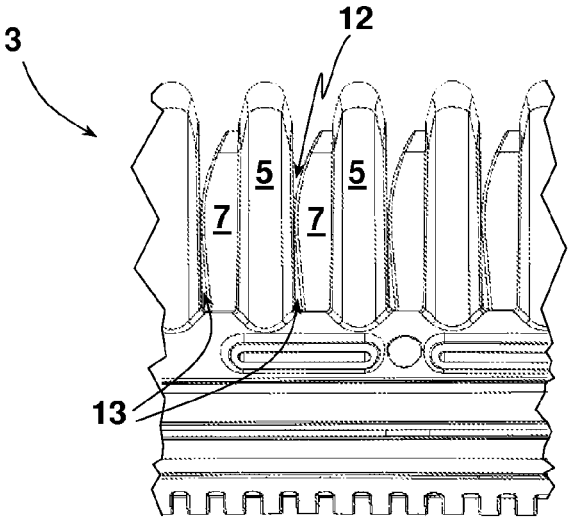
FIG. 4 is an enlarged representation of the straightening tool of FIG. 2 with the movable parts of the straightening tool in a hair straightening position relative to each other.

FIG. 4 is enlarged section of the straightening tool 3 when the first molded parts 7 have closed the respective hair shaping gap 11. This position represents the position of the molded parts 7 during a straightening process. As can be seen, the hair shaping gaps 11 are not completely closed the area of the constrictions 12. Consequently the hair shaping gaps 11 remain open for the hairs that fill the undercut 13 so that the desired hair shaping pressure for straightening is exerted by means of the molded parts on the hairs gathered by the undercuts 13.

Figure 5:
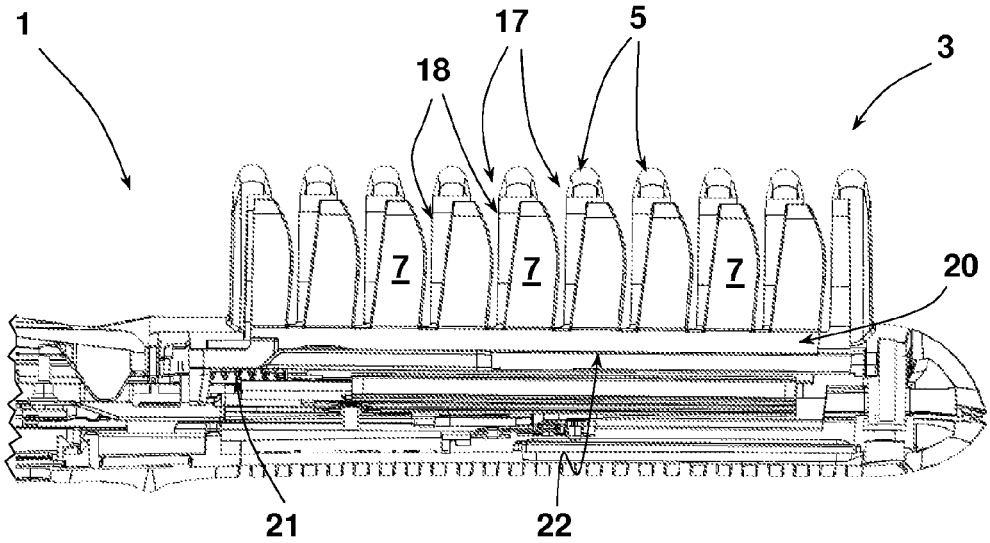
FIG. 5 is a cut away view through the straightening tool of FIG. 2.

The tines 5 are arch-shaped as seen in FIG. 5. This has the advantage that in the open position of the hair shaping gaps 11 the molded parts 7 are not only received by the tine 5 that is associated with the respective molded part 7 (see FIG. 1) but that also during the gathering of only relatively little hair in a hair shaping gap 11 the front side pointing to the neighboring tine 5 can engage the backside of the neighboring tine.

FIG. 5 shows the first molded parts in a position between the open-position shown in FIG. 2 and the closed position shown in FIG. 4. In the closed-position shown in FIG. 4 the molded parts 7 are in a position facing the neighboring tine 5 in the case where a sufficient amount of hair was gathered into the undercut 13 of the hair shaping gap 11 in order for the molded parts 7 not to be further moved into the neighboring tines that form the second molded parts. In the embodiment depicted in FIGS. 1 to 5 the backsides 17 of the neighboring tines 5 act together with the first molded parts 7 to whom the backsides respectively point. In this context the design of the part surface of the molded parts 17 with their shaping flanks 16, 16.1 functions such that a hair shaping takes place at the edge labeled in the FIG. 5 with the reference symbol 18. The shaping force acting on the gathered hairs is then concentrated on this edge.

The first movable molded parts 7 are connected with one another by means of a bar 20 into a rigid concrete unit. This unit that is formed from the bar 20 and the individual molded parts 7 is manufactured by pressure die casting from an aluminum alloy in the depicted embodiment. This unit is adjustable in the direction toward the hand grip 2 by means of the button 8 against the force of a reset spring 21. If the button 8 is not actuated, the reset spring 21 biases the hair shaping gap 11 to the closed position. An actuation of the button 8 for the purpose of opening the hair shaping gap 11 allows the receiving the hair strands in the respective hair receptacles 10 or hair shaping gap 11.

A PTC heater element, which is not further described, is connected to the floor 22 of the bar 20 that connects the molded parts 7 in a disposition on the floor 22 that couples in heat. Its power is adjustable by means of an actuator element that is disposed on the hand grip 2. Due to the good heat conduction capability of the material used for the bar 20 and the molded parts 7 an even and quick distribution of the heat generated by the PTC heater element heats of the parts surfaces of the molded parts 7.

Figure 6:
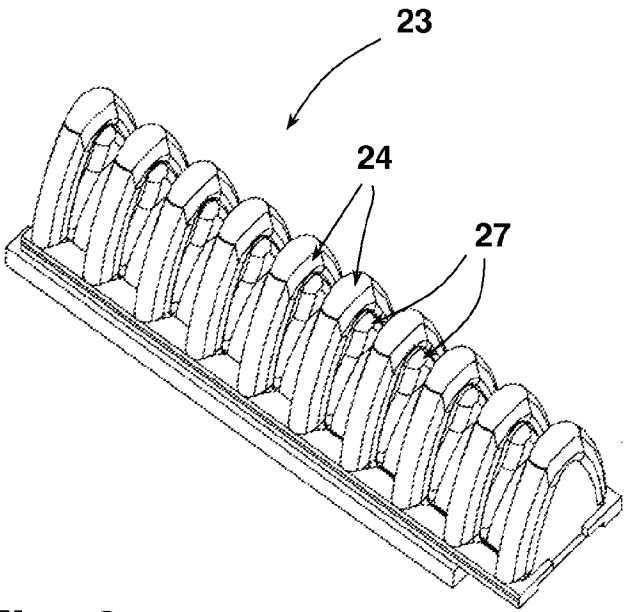
FIG. 6 shows the essential elements of the straightening tool according to a further embodiment for a hair straightener device.

FIGS. 6 and 7 show the essential elements of a straightening tool 23 according to a further embodiment. The straightening tool 23 has a row of tines 5 and a molded part unit 25 with molded parts 27 held together by two bars 26, 26.1 and a second molded parts unit 28, in addition to the components of the first embodiment. The second molded parts unit 28 has individual molded parts 29 that are connected with each other by means of a common bar 30. The molded parts unit 28 is in the depicted embodiment is also a molded part that formed by a pressure die casting from an aluminum alloy.

Figure 9:
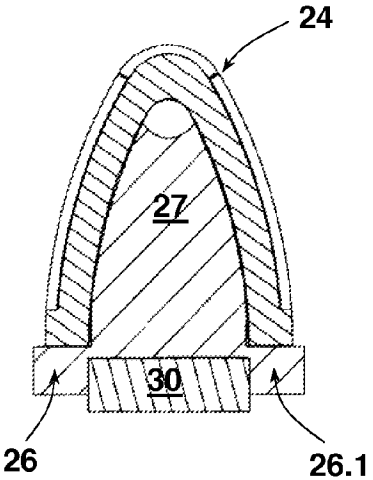
FIG. 9 is a cross-sectional cut through the straightening tool of FIG. 8 along line B-B.
Figure 8:
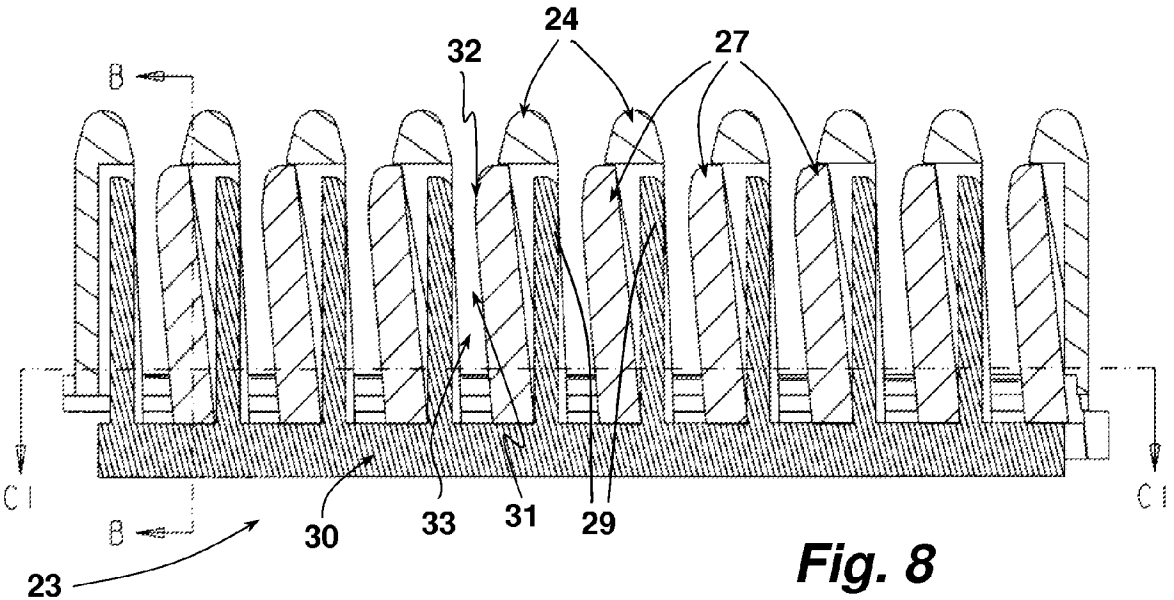
FIG. 8 a cut away view of the straightening tool of FIG. 6 in a longitudinal cut in a first position of its movable molded parts.
Figure 10:
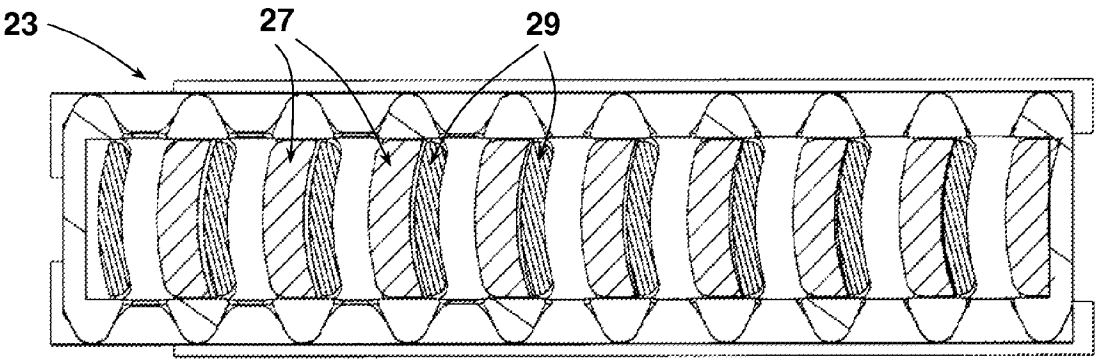
FIG. 10 is a longitudinal cut through the straightening tool of FIG. 8 along line C1-C1.

The disposition of the molded parts 27, 29 relative to each other can be seen in longitudinal cross section in FIG. 8. FIG. 8 presents the straightening tool 23 in the open-position of its molded parts 27. The form parts 27, 29 are gathered in the tines 24 that are arch-shaped. FIG. 9 is a cross section along the line B-B. This shows that the outline geometry of the molded parts 27 and their dimensioning is adapted to the interior lateral surface of the tines 24 that are arch-shaped. The molded parts 29 serve as second molded parts in the straightening tool 23. The representation of the straightening tool 23 in FIG. 8 shows the constriction 32 that closes the hair shaping gap 31 in the direction of the open end of the tines 24 is located near the upper side of the molded parts 27 and as a result the usable height of the hair shaping gaps 31 or the molded parts 27 is correspondingly large for the process of hair shaping. Also in the case of the straightening tool 23 the molded parts unit 25 is adjustable relative to the tines 24 and the molded parts unit 28, with its molded parts 29, that is similarly disposed in a stationary manner. The adjustment movement for the closing of the constriction 32 takes place in the depicted embodiment by the force of one or several spring elements. The opposite movement direction is affected by actuation of a typically manually operable actuator element, for example a button as described in the embodiment example of FIGS. 1 to 5.

Figure 11:
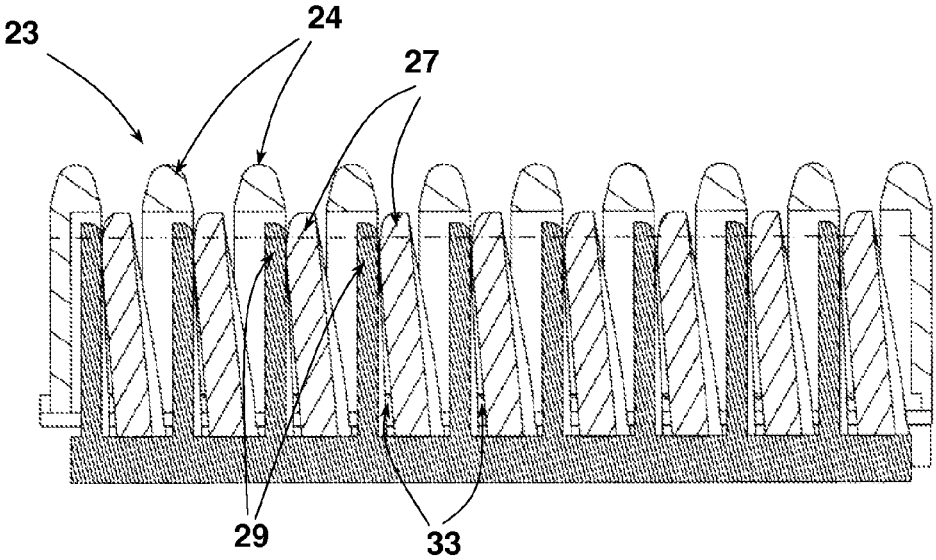
FIG. 11 is a longitudinal cut through the straightening tool of FIG. 8 in the position of its movable parts in the straightening position.

Once hair strands are brought into the hair shaping gap 31 of the straightening tool 23, the actuator element that is holding the molded parts 27 in their open-position is let go so that the hair shaping gaps 31 are closed, as can be seen in FIG. 11. In this straightening tool 23, the process of the hair shaping take place primarily between the molded parts 27, 29. The edges of the tines 24 that point toward the interior serve additionally as a hair shaping edge, as in the embodiment example of FIGS. 1 to 5.

The straightening tool 23 has a heating installation for the supply of heat to the hair to be shaped that is not further described and can be the one of the straightening tool 3 of the hair straightener 1. This heats the molded parts unit 25 and/or the molded parts unit 28.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In general the terms and phrases used herein have their art-recognized meaning, which can be found by reference to standard texts, journal references and contexts known to those skilled in the art. The above definitions are provided to clarify their specific use in the context of the invention.

LIST OF REFERENCE SYMBOLS

1 Hair straightener device
2 Hand grip
3 Straightening tool
4 Connection cable
5 Tine
6 Tip
7 Molded part
8 Button
9 Cover shell
10 Hair receptacle
11 Hair shaping gap
12 Constriction
13 Undercut
14 Border
15 End
16.16.1 Shaping flank
17 Back side
18 Edge
20 Bar
21 Reset spring
22 Floor
23 Straightening tool
24 Tine
25 Molded part unit
26.26.1 Bar
27 Molded part
28 Molded part unit
29 Molded part
30 Bar
31 Hair shaping gap
32 Constriction
33 Undercut

I claim:

1. A hair straightener having a comb like straightening tool comprising:

a plurality of tines spaced apart respectively to each other by one hair receptacle and disposed in a row;

the plurality of tines having a first tine and additional tines;

a first molded part associated with each of said additional tines and disposed in a movable manner relative to the additional tine that borders the hair receptacle;

a second molded part associated with each of the additional tines surrounding the hair receptacle forming a hair shaping gap between the first and second molded parts of the hair receptacle; and wherein the hair shaping gaps located between respective first and second molded parts are undercut at least in a hair shaping position of the molded parts relative to each other in the direction of a border of the hair receptacle that connects the tines.

2. The device of claim 1, wherein the undercut of each hair shaping gap extends in over the entire height of the molded parts in their hair shaping position for the process of the hair straightening.

3. The device of claim 1 wherein the first molded parts are connected together by at least one bar to form a rigid concrete molded parts unit that is movably supported relative to the tines.

4. The device of claim 3, wherein the molded parts unit is formed of a material that conducts heat well and has an electric heating installation for the heating of the molded parts.

5. The device of claim 4, wherein the tines are implemented in an arch-shaped manner and the area surrounded by the respective tine arch features a cross sectional geometry, corresponding to the peripheral surface area of the first molded parts with a dimension such that the first molded parts fit within it.

6. The device of claim 5 wherein the first molded parts are gathered in an open-position of the hair shaping gaps at least partially within the tine arch associated with the respective molded part.

7. The device of the claim 1 wherein the second molded parts are formed by the tines that respectively face the first molded parts that are interacting together with the first molded parts that are supported in a movable manner.

8. The device of claim 1 wherein the second molded parts that are interacting together with the first molded parts are formed by the tines that face the first molded parts with which molded parts are associated.

9. The device of claim 8 wherein the second molded parts are connected together by at least one bar.

10. The device of claim 8 wherein that the second molded parts are formed of a material that conducts heat well.

11. The device of claim 8 wherein the second molded parts are disposed at least partially within a tine arch.

* * * * *